US008764271B2

(12) United States Patent
Miquet

(10) Patent No.: US 8,764,271 B2
(45) Date of Patent: Jul. 1, 2014

(54) BASE FOR MOUNTING AN ELECTRICAL DEVICE SUCH AS A LIGHT-EMITTING DIODE

(75) Inventor: Pascal Miquet, Pouru-Saint-Remy (FR)

(73) Assignee: Amphenol—Air LB, Blagny (FR)

( * ) Notice: Subject to any disclaimer, the term of this patent is extended or adjusted under 35 U.S.C. 154(b) by 547 days.

(21) Appl. No.: 12/938,730

(22) Filed: Nov. 3, 2010

(65) Prior Publication Data

US 2011/0103082 A1 May 5, 2011

(30) Foreign Application Priority Data

Nov. 5, 2009 (FR) ..... 09 57841

(51) Int. Cl.
*H01R 33/00* (2006.01)

(52) U.S. Cl.
USPC ..... 362/656; 313/318.1; 439/595; 362/652; 362/800

(58) Field of Classification Search
USPC ..... 362/625–659, 800; 439/595; 313/318.05, 318.06, 318.09, 318.1
See application file for complete search history.

(56) References Cited

U.S. PATENT DOCUMENTS

| | | | | |
|---|---|---|---|---|
| 3,838,382 | A | 9/1974 | Sugar | |
| 4,204,740 | A | 5/1980 | Krolak | |
| 4,636,020 | A | 1/1987 | Marmillion | |
| 5,730,624 | A * | 3/1998 | Lester et al. | 439/595 |
| 7,938,565 | B2 * | 5/2011 | Richard | 362/652 |

FOREIGN PATENT DOCUMENTS

DE 1790043 A1 12/1971

OTHER PUBLICATIONS

French Search Report, dated Jun. 8, 2010, from corresponding French application.

* cited by examiner

*Primary Examiner* — Stephen F Husar
(74) *Attorney, Agent, or Firm* — Young & Thompson

(57) ABSTRACT

This base for the mounting of an electrical device comprises a body (3) in two portions that are mounted one on the other, female connection contacts (14) placed in passageways (13) provided in the body and designed to interact with male connection pins of the device, and means (15) for retaining the female connection contacts (14) in the passageways.
The base is made of plastic, the retention means (15) being made of the same material and in one piece with the body.
The invention finds an application in the mounting of a light-emitting diode.

11 Claims, 2 Drawing Sheets

FIG.1
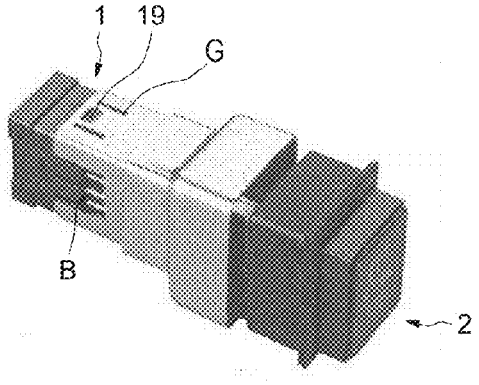
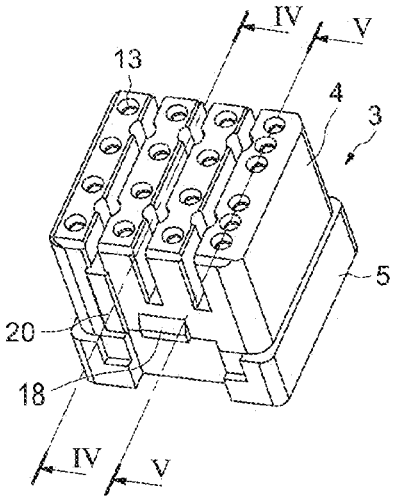
FIG.2
FIG.3
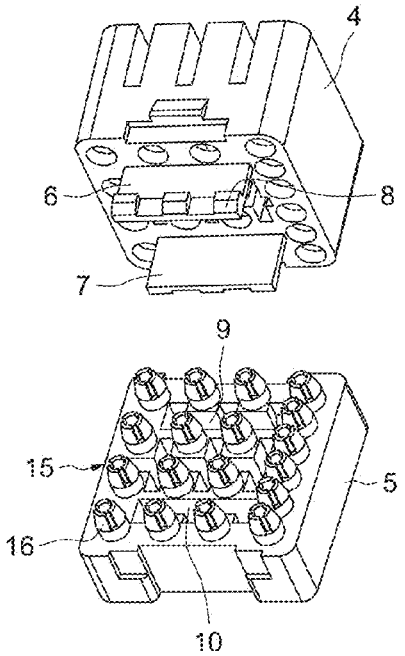

BASE FOR MOUNTING AN ELECTRICAL DEVICE SUCH AS A LIGHT-EMITTING DIODE

The invention relates generally to the mounting of electrical devices of the light-emitting diode type.

A particularly advantageous, but non-limiting, application of the invention relates to the mounting of an indicator light-emitting diode on a console and the electrical connection of the light-emitting diode with wire elements provided at the rear of the console.

Bases of this type are already known in the prior art.

Such bases usually comprise a body comprising two portions in which a set of contacts are placed for the purpose of interacting, on the one hand, with pins of the light-emitting diode and, on the other hand, with cables crimped onto the contacts.

The body also comprises, for example, metal elastic parts placed between the two portions of the body, for example in passageways provided for the insertion of the contacts, in order to retain the latter in the passageways.

These metal parts form fitted elements and thus increase the complexity of the assembly. They are also a negative impact on the production cost of the base.

The object of the invention is to remedy this drawback.

The subject of the invention is therefore a base for the mounting of an electrical device, such as a light-emitting diode, comprising a body in two portions, female connection contacts placed in passageways provided in the body and designed to interact with male connection pins of the device, and means for retaining the female connection contacts in the passageways.

According to a general feature of the base, the latter is made of plastic, the retention means being made of the same material and in one piece with the body.

According to another feature of the body, the retention means are made in the form of snap-fitting lugs.

The retention means also comprise, according to another feature, an end abutment for a free end of each female contact.

For example, the retention means comprise a set of snap-fitting heads each extending in line with a passageway of one of the portions of the body and each comprising a set of sectors forming the said snap-fitting lugs.

In one embodiment, each head comprises three snap-fitting lugs.

The base also comprises means for attaching the two portions of the body.

For example, these attachment means comprise snap-fitting tongues extending from one of the portions of the body and designed to interact with matching snap-fitting means provided in the other portion of the body.

The base may also comprise error-preventing means for the mounting of the light-emitting diode, the said error-preventing means being made of the same material and in one piece with the body.

This further reduces the number of operations used for the mounting of the electrical device, particularly of the light-emitting diode on the base, and the manufacturing costs are further reduced.

For example, the error-preventing means comprise a protruding relief designed to interact with a groove made in the light-emitting diode.

Other objects, features and advantages of the invention will appear on reading the following description, given only as a non-limiting example, and made with reference to the appended drawings in which:

FIG. 1 is a view in perspective of a base according to the invention, on which a light-emitting diode is mounted;

FIG. 2 is a view in perspective of a base according to the invention;

FIG. 3 shows the base of FIG. 2 in the disassembled state;

FIG. 1 shows a view in perspective of a base according to the invention, indicated by the general reference number 1, on which a light-emitting diode 2 is mounted.

Figure 4:
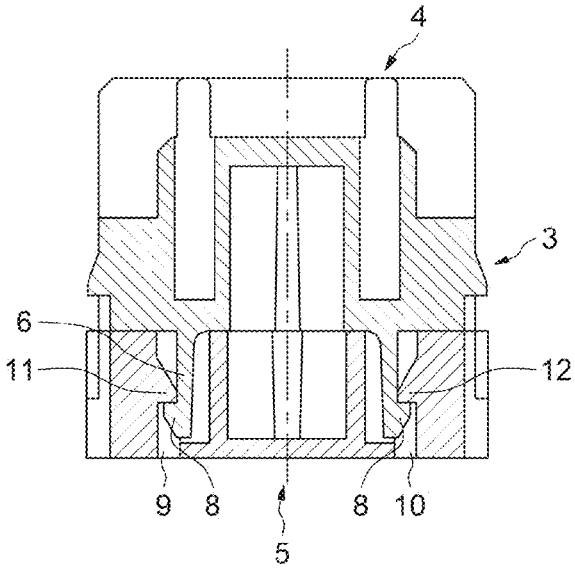
FIG. 4 is a view in section along the line IV-IV of the base of FIG. 2, showing the arrangement of the means for attaching the two portions of the body.

In a particular application, the light-emitting diode 2 consists of a light-emitting diode that is mounted on a console of an aircraft cockpit, the base 1 being designed to provide the electrical connection of the light-emitting diode 2 with wire elements provided on the rear face of the console.

But there is no departure from the context of the invention when the base 1 is designed to receive any other electrical device provided with pins B, for which it provides the electrical connection.

With reference to FIGS. 2 and 3, the base 1 comprises a body 3 comprising two portions 4 and 5, namely an anterior portion 4 turned towards the light-emitting diode 2 and a posterior portion 5.

Attachment means attach the two portions 4 and 5 to one another. These attachment means are made, in the exemplary embodiment shown, in the form of tongues 6 and 7, in this instance two in number, extending from one of the portions of the body, in this instance, the anterior portion 4, and each provided with hooks 8, in this instance three in number.

With reference also to FIG. 4, these tongues 6 and 7 are inserted, at the time of mounting, into slots 9 and 10 provided in the other portion 5.

For example, the end hooks 8 are turned outwards.

The slots 9 and 10 then comprise two snap-fitting teeth 11 and 12 turned inwards into which the end hooks 8 snap.

By virtue of the presence of the tongues 6 and 7 provided with end hooks 8, which interact with the teeth 11 and 12, it is possible to effectively assemble the two portions 4 and 5 of the body 2.

Figure 5:
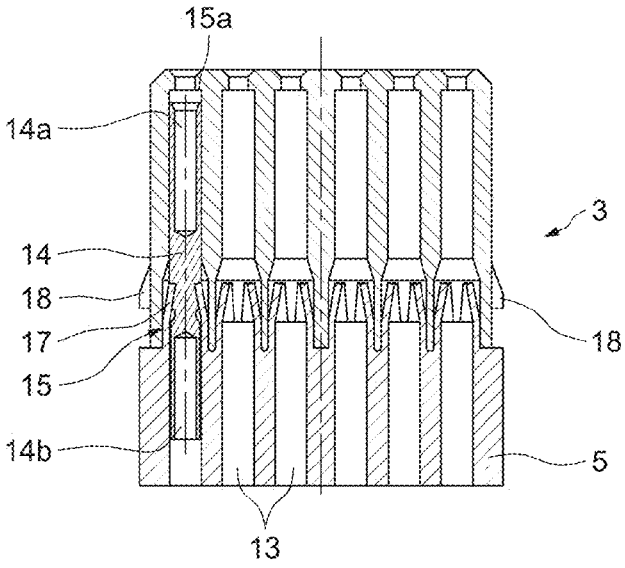
FIG. 5 is a view in section along the line V-V of the base of FIG. 2.

As shown in FIG. 5, the body comprises a set of passageways, such as 13 arranged so that the passageways of the anterior portion 4 extend coaxially with the passageways of the posterior portion 5.

These passageways, such as 13, are designed for the insertion of female contacts 14. In FIG. 5, in the interests of clarity, only one of the contacts 14 has been shown.

Each contact 14 comprises a first anterior end 14*a* turned towards the light-emitting diode and a second posterior end 14*b*.

The anterior end 14*a* forms a female contact and is designed to receive the pins B of the light-emitting diode.

The other end 14*b* is designed to receive wire elements provided at the rear of the console. For example, these wire elements consist of cables crimped onto this posterior end 14*b*.

In order to retain the contacts 14, on the one hand in the passageways provided in the anterior portion 4 and, on the other hand, in the passageways provided in the posterior portion 5, the body 2 comprises a set of snap-fitting heads, such as 15, protruding from one of the walls, in this instance the wall 5, in line with the corresponding passageway 13 and end abutments 15*a* made in the form of a bore provided in the wall of the passageways 13.

The contacts 14 are therefore retained between the snap-fitting heads which prevent the extraction of the contacts by the posterior portion 5, and the end abutments 15*a* against which the anterior end 14*a* of each contact 14 abuts and which thus prevent the extraction of the contacts by the anterior portion 4.

It will be noted that, at the time of mounting, the female contact 14, provided with the crimped cable (not shown), is inserted by its female end designed to receive the pins B in the posterior end of the passageway 13 provided in the posterior portion 5.

Then, the snap-fitting heads 15 extend in this instance from the anterior face of the posterior portion 5, that is to say the face designed to be turned towards the portion 4.

The snap-fitting heads 15 are for example provided with a set of sectors, such as 16, in this instance three in number, each delimiting a snap-fitting lug, so that each head comprises three lugs into which the female contact 14 snaps.

The contact 14 is therefore provided with an annular groove 17 into which, at the time of mounting, the ends of the snap-fitting lugs 16 snap.

It will be noted that the body 3, and in particular the anterior and posterior portions 4 and 5, are made by plastic moulding. Such is the case in particular of the heads 15 which are moulded together with the posterior portion 5.

Therefore, each of the portions 4 and 5 is completely made during one and the same moulding operation.

It will be noted finally that the body 3, and in particular the anterior portion 4, comprises snap-fitting means for the retention of the light-emitting diode, in the form of two opposite catches 18 designed to be inserted into two corresponding windows, such as 19, provided in the casing of the light-emitting diode (FIG. 1).

Again with reference to FIG. 2, it will also be noted that the anterior portion 4 of the base 1 also comprises error-preventing means 20, designed to allow the light-emitting diode to be mounted on its base in only one respective position of the light-emitting diode and of the base.

These error-preventing means are in this instance made in the form of a relief, also moulded with the anterior portion 4 which is designed to be inserted, at the time of mounting, into a groove G made in the casing of the light-emitting diode 2.

Therefore, unlike the prior art, in which the error-preventing means can be made in the form of a metal part which is inserted, at the time of mounting, into one housing amongst several housings provided for this purpose, in the body of the base, the error-preventing means are in this instance made during the moulding so that it is not possible, when the light-emitting diode is mounted, to change the position of the error-preventing means, thereby ensuring that the light-emitting diode is directly mounted on the base.

The invention claimed is:

1. A base for the mounting of an electrical device, such as a light-emitting diode, comprising a body (3) having two mating portions (4, 5) being mounted one on the other, female connection contacts (14) placed in passageways provided in the body (3) and designed to interact with male connection pins of the device, and retention means for retaining the female connection contacts (14) in the passageways, wherein said base is made of plastic, the retention means (15) being made of the same material and in one piece with the body, and wherein said body comprises attachment elements (6, 7) formed integrally with the two mating portions and positioned within an outer perimeter of the body.

2. The base according to claim 1, characterized in that the retention means comprise snap-fitting lugs (16).

3. The base according to claim 2, characterized in that the retention means also comprise, for each female contact (14), an end abutment (15*a*) for a free end (14*a*) of the female contact (14).

4. The base according to claim 2, characterized in that the retention means comprise a set of snap-fitting heads (15) each extending in line with a passageway (13) of one of the portions of the body and each comprising a set of sectors forming the said snap-fitting lugs (16).

5. The base according to claim 4, characterized in that each head comprises three snap-fitting lugs (16).

6. The base according to claim 5, characterized in that the attachment elements comprise snap-fitting tongues (6, 7) extending from one of the portions of the body and designed to interact with a matching snap-fitting element (11, 12) provided in the other portion of the body.

7. The base according to claim 1, further comprising a locator element (20) for mounting the light-emitting diode in a predetermined orientation, said locator element being made of the same material and in one piece with the body.

8. The base according to claim 7, characterized in that the locator element comprises a protruding relief (20) designed to interact with a groove in the light-emitting diode.

9. The base according to claim 3, characterized in that the retention means comprise a set of snap-fitting heads (15) each extending in line with a passageway (13) of one of the portions of the body and each comprising a set of sectors forming the said snap-fitting lugs (16).

10. The base according to claim 9, characterized in that each head comprises three snap-fitting lugs (16).

11. The base according to claim 10, characterized in that the attachment elements comprise snap-fitting tongues (6, 7) extending from one of the portions of the body and designed to interact with a matching snap-fitting element (11, 12) provided in the other portion of the body.

* * * * *